US011572511B2

(12) United States Patent
Tsai et al.

(10) Patent No.: US 11,572,511 B2
(45) Date of Patent: Feb. 7, 2023

(54) INTEGRATED PROCESS FOR PYROLYSIS AND STEAM CRACKING

(71) Applicant: UOP LLC, Des Plaines, IL (US)

(72) Inventors: Robert Tsai, Des Plaines, IL (US); Michael S. Allegro, II, Wood Dale, IL (US); Elizabeth Carter, Arlington Heights, IL (US); Joseph Montalbano, Elmhurst, IL (US); Matthew Griffiths, Northbrook, IL (US); John Goodman, Katy, TX (US); Thuy Vu, Buffalo Grove, IL (US); Andrea Bozzano, Northbrook, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 17/333,921

(22) Filed: May 28, 2021

(65) Prior Publication Data

US 2022/0380681 A1 Dec. 1, 2022

(51) Int. Cl.

| | |
|---|---|
| ***C10G 1/00*** | (2006.01) |
| ***C10G 1/10*** | (2006.01) |
| ***C10G 69/06*** | (2006.01) |

(52) U.S. Cl.

CPC ..... *C10G 1/10* (2013.01); *C10G 1/002* (2013.01); *C10G 69/06* (2013.01); *C10G 2300/1003* (2013.01); *C10G 2400/30* (2013.01)

(58) Field of Classification Search

CPC ..... C10G 1/00

See application file for complete search history.

(56) References Cited

U.S. PATENT DOCUMENTS

| | | | | |
|---|---|---|---|---|
| 2016/0362609 | A1* | 12/2016 | Ward | C10G 69/02 |
| 2020/0080009 | A1* | 3/2020 | Derks | C10G 21/14 |
| 2021/0189248 | A1* | 6/2021 | Timken | C10G 1/10 |
| 2022/0195309 | A1* | 6/2022 | Uppili | C10G 1/002 |

* cited by examiner

*Primary Examiner* — Randy Boyer

(74) *Attorney, Agent, or Firm* — Paschall & Associates, LLC; James C. Paschall

(57) ABSTRACT

A process for converting pyrolysis effluent stream into hydrocarbon products. Waste plastics are pyrolyzed at high temperature in a pyrolysis reactor to obtain a plastic pyrolysis effluent stream. The plastic pyrolysis effluent stream is further sent to a steam cracking unit for the separation of plastic pyrolysis effluent stream into a C5+ hydrocarbon stream and a C4 hydrocarbon stream. The pyrolysis reactor is operated at a to obtain hydrocarbon products of high value.

18 Claims, 3 Drawing Sheets

INTEGRATED PROCESS FOR PYROLYSIS AND STEAM CRACKING

FIELD

The field relates to recycling of waste plastics into hydrocarbon products. More particularly relates to a process for converting waste plastics into hydrocarbon products by steam cracking of pyrolysis effluent.

BACKGROUND

The recovery and recycle of waste plastics is held with deep interest by the public which has been participating in the front end of the process for decades. Past plastic recycling paradigms can be described as mechanical recycling. Mechanical recycling entails sorting, washing, and melting recyclable plastic articles to molten plastic materials to be remolded into a new clean article. The melt and remolding paradigm have encountered several limitations, including economic and qualitative. Collection of recyclable plastic articles at materials recovery facilities inevitably includes non-plastic articles that had to be separated from the recyclable plastic articles. Similarly, collected articles of different plastics must be separated from each other before undergoing melting because the articles molded of different plastics would not typically have the quality of an article molded of the same plastic. Separation of collected plastic articles from non-plastic articles and then into the same plastics adds expense to the process that makes it less economical. Additionally, recyclable plastic articles must be properly cleaned to remove non-plastic residues before melting and remolding which also adds to the expense of the process. The recovered plastic also does not possess the quality of virgin grade resins. The burdensome economics of the plastic recycling process and the lower quality of recycled plastic have prevented widespread renewal of this renewable resource.

A paradigm shift has enabled the chemical industry to rapidly respond with new chemical recycling processes for recycling waste plastics. The new paradigm is to chemically convert the recyclable plastics in a pyrolysis process operated at about 350° C. (662° F.) to about 600° C. (1112° F.) to liquids. The liquids can be refined in a refinery to fuels, petrochemicals and even monomers that can be re-polymerized to make virgin plastic resins. The pyrolysis process still requires separation of collected non-plastic materials from plastic materials fed to the process, but cleaning and perhaps sorting of plastic materials may not be as critical in chemical recycling.

Higher temperature pyrolysis is under investigation and is viewed as a route to convert plastics directly to monomers without further refining. Conversion of plastics back to monomers presents a circular way of recycling a renewable resource that yet has not been fully economically developed. What is needed is a viable process to convert plastic articles directly back to monomers.

SUMMARY OF INVENTION

We have discovered a process for converting a waste plastic feed or a pyrolysis effluent stream into hydrocarbon products. The process provides pyrolyzing a plastic feed at a temperature of at least 450° C. in a pyrolysis reactor to obtain a plastic pyrolysis effluent stream. The process further provides passing the plastic pyrolysis effluent stream to a steam cracking unit to obtain a steam cracked effluent stream and separating the steam cracked effluent stream into a C5 hydrocarbon stream and a C4 hydrocarbon stream. The pyrolysis reaction can be conducted at a very high temperature to obtain hydrocarbon products of high value. The plastics pyrolysis effluent stream may enter the steam cracking unit upstream or downstream of the steam cracking reactor.

These and other features, aspects, and advantages of the present disclosure are further explained by the following detailed description, drawing and appended claims.

BRIEF DESCRIPTION OF THE DRAWINGS

The various embodiments will hereinafter be described in conjunction with FIG. 1, wherein like numerals denote like elements.

Figure 1:
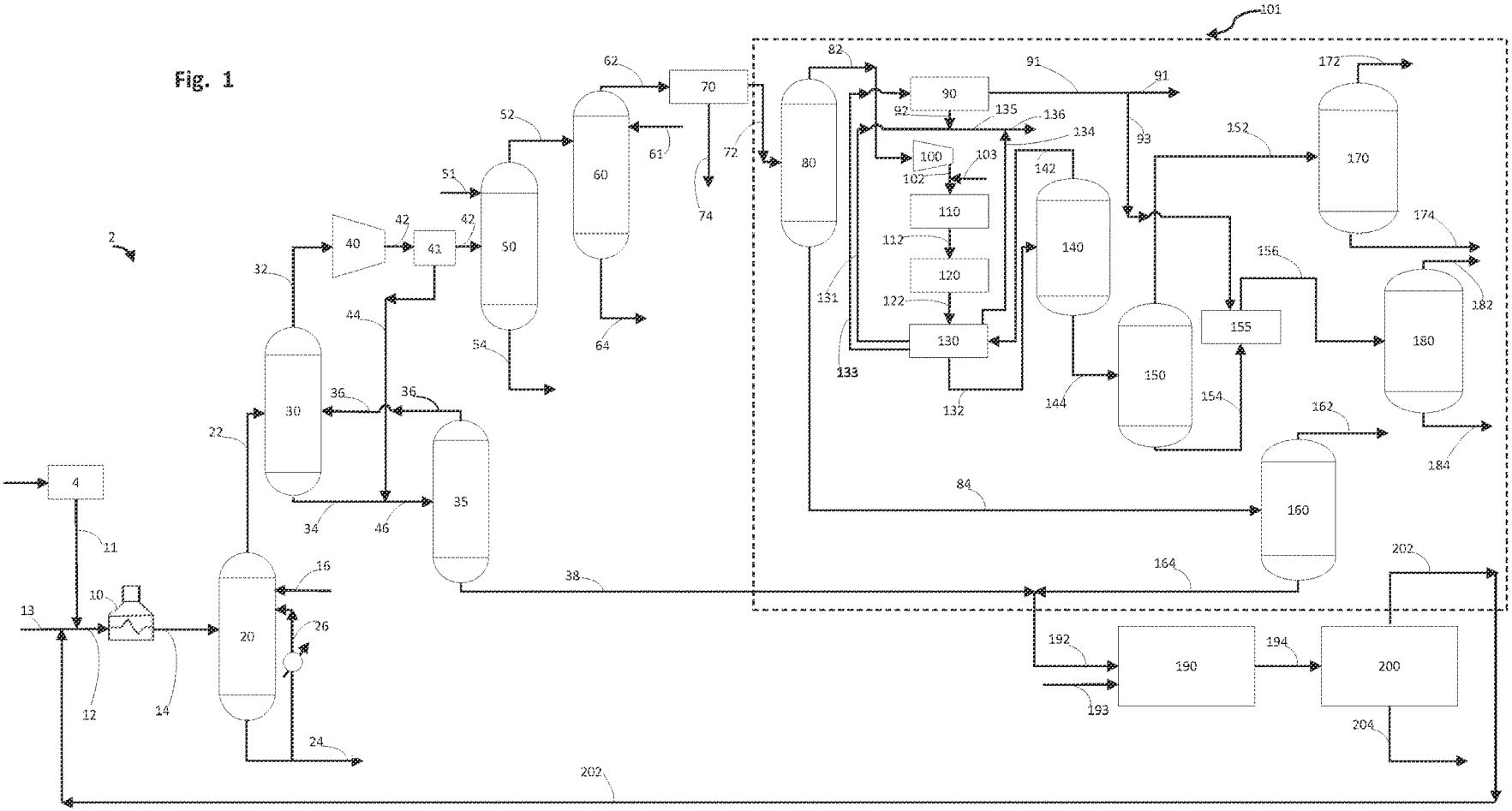
FIG. 1 is a schematic drawing of a process and apparatus of the present disclosure.
Figure 2:
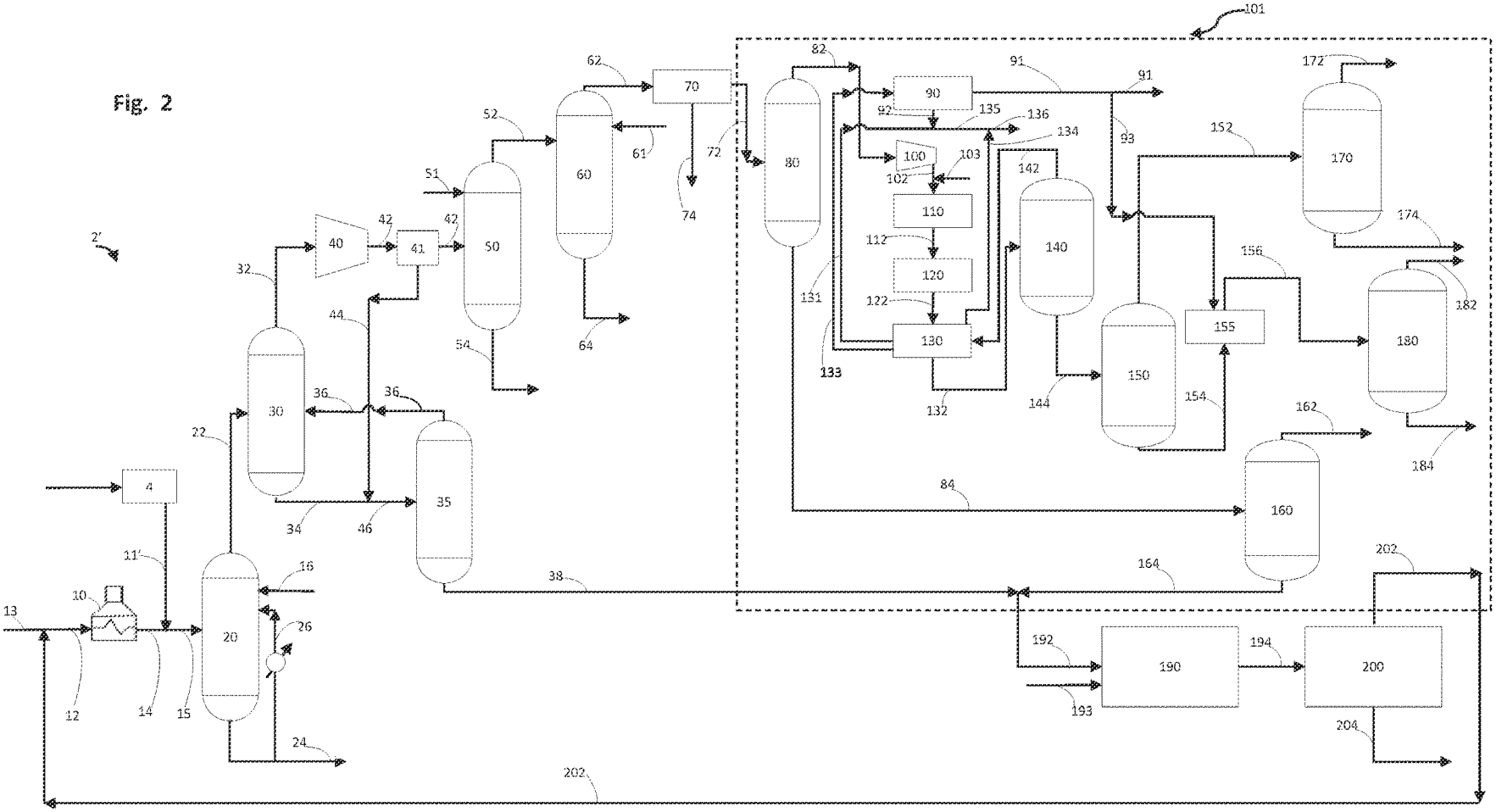
FIG. 2 is an alternative embodiment of FIG. 1.
Figure 3:
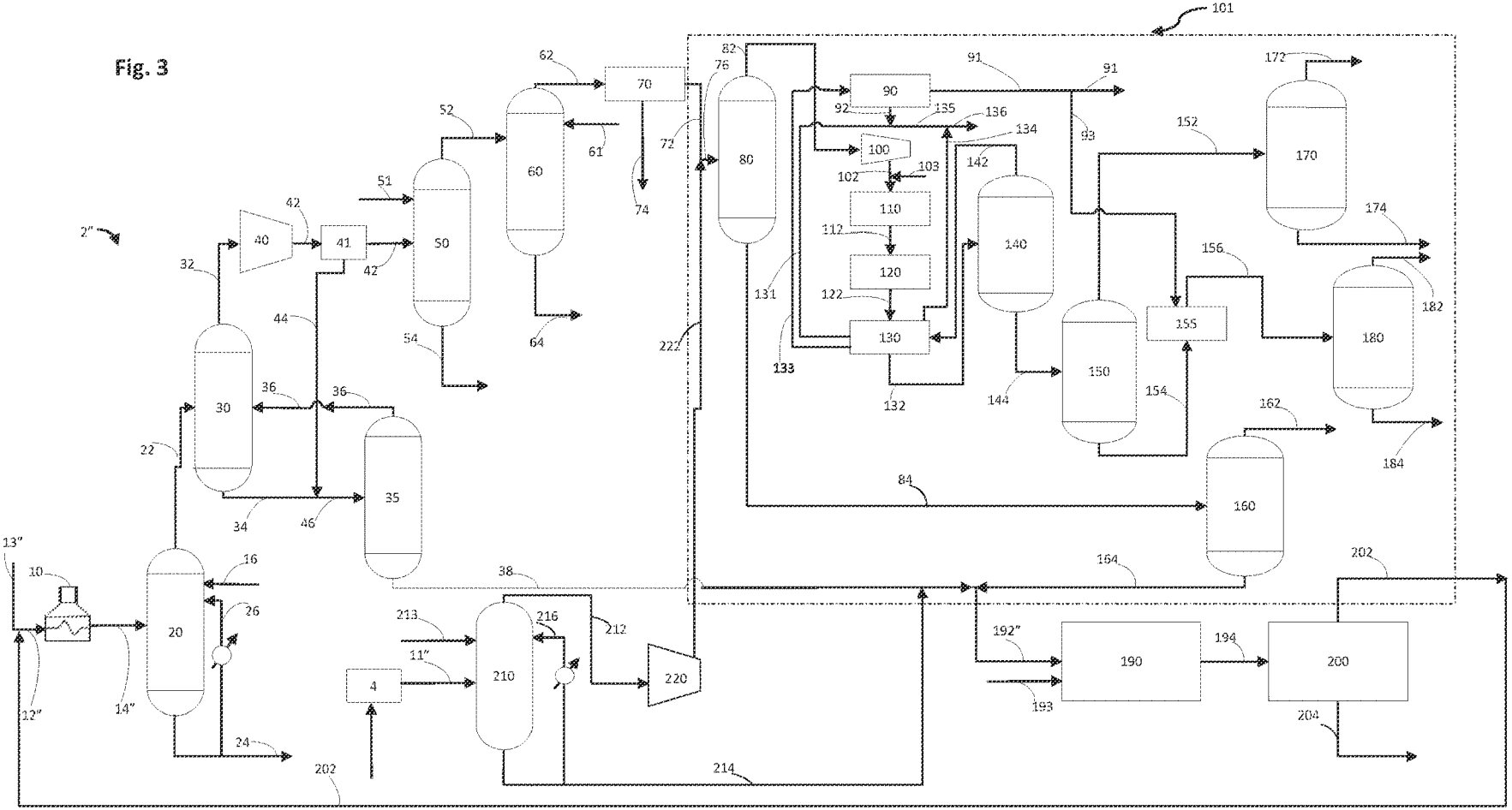
FIG. 3 depicts an alternative embodiment of FIG. 2.

Skilled artisans will appreciate that elements in FIGS. 1-3 are illustrated for simplicity and clarity and have not necessarily been drawn to scale. For example, the dimensions of some of the elements in FIGS. 1-3 may be exaggerated relative to other elements to help to improve understanding of various embodiments of the present disclosure. Also, common but well-understood elements that are useful or necessary in a commercially feasible embodiment may not be depicted to facilitate a less obstructed view of these various embodiments of the present disclosure.

DEFINITIONS

The term "communication" means that fluid flow is operatively permitted between enumerated components, which may be characterized as "fluid communication".

The term "downstream communication" means that at least a portion of fluid flowing to the subject in downstream communication may operatively flow from the object with which it fluidly communicates.

The term "upstream communication" means that at least a portion of the fluid flowing from the subject in upstream communication may operatively flow to the object with which it fluidly communicates.

The term "direct communication" means that fluid flow from the upstream component enters the downstream component without passing through any other intervening vessel.

The term "indirect communication" means that fluid flow from the upstream component enters the downstream component after passing through an intervening vessel.

The term "bypass" means that the object is out of downstream communication with a bypassing subject at least to the extent of bypassing.

The term "predominant", "predominance" or "predominate" means greater than 50%, suitably greater than 75% and preferably greater than 90%.

The term "carbon-to-gas mole ratio" means the ratio of mole rate of carbon atoms in the plastic feed stream to the mole rate of gas in the diluent gas stream. For a batch process, the carbon-to-gas mole ratio is the ratio of moles of carbon atoms in the plastic in the reactor to the IO moles of gas added to the reactor.

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., C3+ or C3−, which is inclusive of the abbreviated one or more hydrocarbons. As an example, the abbreviation "C3+" means one or more hydrocarbon molecules of three carbon atoms and/or more. In addition, the term "stream" may be applicable to other fluids, such as aqueous and non-aqueous solutions of alkaline or basic compounds, such as sodium hydroxide.

As used herein, the term "zone" can refer to an area including one or more equipment items and/or one or more units. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "weight percent" may be abbreviated "wt. %" and unless otherwise specified the notation "%" refers to "wt. %"".

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottom stream back to the bottom of the column. Feeds to the columns may be preheated. The top pressure is the pressure of the overhead vapor at the outlet of the column. The bottom temperature is the liquid bottom outlet temperature. Overhead lines and bottom lines refer to the net lines from the column downstream of the reflux or reboil to the column.

As used herein, the term "rich" can mean an amount of at least generally 80%, or 90%, and or 99%, by mole, of a compound or class of compounds in a stream.

As used herein, the term "a component-rich stream" means that the rich stream coming out of a vessel has a greater concentration of the component than the feed to the vessel.

As used herein, the term "hour" may be abbreviated "hr.", the term "kilopascal" may be abbreviated "kPa", the term "megapascal" may be abbreviated "MPa", and the terms "degrees Celsius" may be abbreviated "° C.".

DETAILED DESCRIPTION

We have discovered an improved steam cracking process for processing a high-temperature plastic pyrolysis effluent stream. The plastic pyrolysis effluent stream is produced by pyrolysis of plastic feed. The pyrolysis effluent stream can be separated into a gaseous pyrolysis product stream that comprises light olefin product and a liquid stream comprising heavier products. The light olefin product can be separated by fractionation to recover light hydrocarbons that comprise C1-C3 hydrocarbons including C2-C3 olefins while the heavier products are further separated to recover heavier hydrocarbons. The pyrolysis effluent stream is recovered at elevated temperature, cooled, and separated into lighter and heavier hydrocarbon products. By recovering the light olefin products early, they are preserved from cracking or oligomerizing into less desirable products. This reduces the need for any additional cracking of the pyrolysis effluent stream.

The plastic feed can comprise polyolefins such as polyethylene and polypropylene. Any type of polyolefin plastic is acceptable even if mixed with other monomers randomly or as a block copolymer. Hence, a wider range of plastics may be recycled according to this process. The plastics feed can be mixed polyolefins. Polyethylene, polypropylene, and polybutylene can be mixed. Additionally, other polymers can be mixed with the polyolefin plastics or provided as feed by itself. Other polymers that can be used by itself or with other polymers include polyethylene terephthalate, polyvinyl chloride, polystyrene, polyamides, acrylonitrile butadiene styrene, polyurethane, and polysulfone. Many different plastics can be used in the feed because the process pyrolyzes the plastic feed to smaller molecules including light olefins. The plastic feed stream may contain non-plastic impurities such as paper, wood, aluminum foil, some metallic conductive fillers or halogenated or nonhalogenated flame retardants.

In an embodiment, the plastic feed stream may be obtained from a materials recycling facility (MRF) that is otherwise sent to a landfill. The plastic feed stream is used as feedstock for a pyrolysis reactor. The pyrolysis reactor can be a low-temperature pyrolysis reactor or a high-temperature pyrolysis reactor. For the instant disclosure a pyrolysis reactor 4 preferably operates at higher temperature, so as to produce a plastic pyrolysis effluent that is completely in the vapor phase upon exiting the pyrolysis reactor 4. In FIG. 1, the plastic feed stream is received with minimal sorting and cleaning at the MRF site. The plastic feed may be compressed plastic articles from a separated bail of compacted plastic articles. The plastic articles can be chopped into plastic chips or particles which may be fed to the pyrolysis reactor 4. An auger reactor or an elevated hopper may be used to transport the plastic feed as whole articles or as chips into the reactor. Plastic articles or chips may be heated to above the plastic melting point into a melt and injected or augered into the pyrolysis reactor 4. An auger may operate in such a way as to move whole plastic articles into the pyrolysis reactor 4 and simultaneously melt the plastic articles in the auger by friction or by indirect heat exchange into a melt which enters the reactor in a molten state. The plastic feed stream in the disclosure, is fed to the pyrolysis reactor 4.

The pyrolysis reactor 4 may be a continuous stirred tank reactor, a rotary kiln, an auger reactor, or a fluidized bed reactor. The pyrolysis reactor 4 may employ an agitator. In the pyrolysis reactor 4, the plastic feed stream is heated to a temperature that pyrolyzes the plastic feed stream to a pyrolysis effluent stream. The feed stream may be pyrolyzed using various pyrolysis methods including fast pyrolysis and other pyrolysis methods such as vacuum pyrolysis, slow pyrolysis, and others. Fast pyrolysis includes rapidly imparting a relatively high temperature to feedstocks for a very short residence time, typically about 0.5 seconds to about 0.5 minutes, and then rapidly reducing the temperature of the pyrolysis effluent before chemical equilibrium can occur. By this approach, the structures of the polymers are broken into reactive chemical fragments that are initially formed by depolymerization and volatilization reactions, but do not persist for any significant length of time. Fast pyrolysis is an intense, short duration process that can be carried out in a variety of pyrolysis reactors such as fixed bed pyrolysis reactors, fluidized bed pyrolysis reactors, circulating fluidized bed reactors, or other pyrolysis reactors capable of fast pyrolysis.

The plastic feed injected into the pyrolysis reactor 4 may be contacted with a diluent gas stream. The diluent gas stream is preferably inert, but it may be a hydrocarbon gas. Steam is a preferred diluent gas stream. The diluent gas stream separates reactive olefin products from each other to preserve the selectivity to light olefins thus avoiding oligomerization of light olefins to higher olefins or over cracking to light gas. The diluent gas stream may be blown into the pyrolysis reactor 4 through a diluent inlet distributor. The diluent gas stream may be used to impel the plastic feed stream from the reactor inlet to an outlet of the reactor. In an aspect, the feed inlet may be at a lower end of the pyrolysis reactor 4 and the outlet may be at an upper end of the reactor. In the pyrolysis reaction, the temperature will be much higher than the melting temperature of the plastic at which the plastic may be fed to the pyrolysis reactor 4. The plastic feed can be preheated to high temperature before it is fed to the pyrolysis reactor 4 but is preferably heated to pyrolysis temperature after entering the pyrolysis reactor 4.

In an aspect, we have found that the diluent gas stream can be introduced at a high carbon-to-gas mole ratio of about 0.6 to about 20. The high carbon-to-gas mole ratio importantly reduces the amount of diluent gas that must be separated from other gases including product gases. In an embodiment, the fresh plastic feed is heated to high-temperature pyrolysis temperature by contacting it with a stream of hot heat carrier particles. The stream of hot heat carrier particles may be an inert solid particulate such as sand. Additionally, spherical particles may be most easily lifted or fluidized by the diluent gas stream.

In the pyrolysis reactor 4, the plastic feed stream is heated to an elevated temperature of at least 450° C. (842° F.), or suitably about 500° C. (932° F.) to about 1100° C. (2012° F.), or preferably more than about 600° C. (1112° F.), and a pressure of about 150 kPag (21.76 psig) to about 200 kPag (29 psig).

In an aspect, the pyrolysis reactor 4 may operate in a fast-fluidized flow regime or in a transport or pneumatic conveyance flow regime with a dilute phase of heat carrier particles. The pyrolysis reactor 4 may operate as a riser reactor. The plastic feed stream will quickly vaporize upon heating in the pyrolysis reactor 4, pyrolyze and flow with the diluent gas stream.

With fresh plastic feed, in a fast-fluidized flow or transport flow regime, the stream of globs of heat carrier particles and molten plastic undergoing pyrolysis, gaseous pyrolyzed plastic and the diluent gas stream will flow upwardly together. A quasi-dense bed of plastic and heat carrier particle globs will undergo pyrolysis at the bottom of the pyrolysis reactor 4. The globs of plastic and heat carrier particles will transport upwardly upon sufficient size reduction due to pyrolysis.

The plastic pyrolysis effluent stream comprising heat carrier particles, diluent gas stream, high temperature pyrolyzed product gas, and pyrolyzed oil. The effluent may further comprise simpler lighter hydrocarbon molecules, including ethylene and propylene most notably generated at significant fractions within the effluent from the pyrolysis reactor 4. As an example, the pyrolysis reactor 4 operating as fluidized bed reactor, operating above 800° C. or preferably at 825° C., yields product which may on a mass-basis comprise approximately about 10 wt % to about 30 wt % ethylene, about 5 wt % to about 15 wt % and preferably about 8 wt % to about 10 wt % propylene, about 5 wt % to about 15 wt % mixed C4 and C5 hydrocarbons, about 12 w % to about 30 wt % BTX aromatics comprising mixture of benzene, toluene, xylenes, about 12 w % to about 30 wt % non-BTX gasoline-range material such as C6-C11 hydrocarbons, and remainder amount of coke and light ends. The plastic pyrolysis effluent stream may alternatively comprise a combined effluent stream comprising preferably about 65 wt % to about 85 wt % or at least about 70 wt % of olefins and aromatics combined or approximately comprising at least about 40 wt % olefins and at least about 30 wt % aromatics. The plastic pyrolysis effluent stream may comprise no less than about 20 wt % C5− olefins and suitably no less than about 40 wt % C5− olefins. The plastic pyrolysis effluent stream exits the pyrolysis reactor 4 in the vapor phase.

In an embodiment, the plastic pyrolysis effluent stream obtained from pyrolysis of the plastic feed stream in the pyrolysis reactor 4 at a temperature of about 450° C., or about 500° C., or greater, is transferred to a steam cracking unit 2 for further pyrolysis and separation or mere separation of the plastic pyrolysis effluent stream to obtain separate hydrocarbon streams such as C3, C4, or C5 hydrocarbon streams.

As shown in the embodiment of FIG. 1, the plastic pyrolysis effluent stream in line 11 may optionally be passed for steam cracking in a steam cracking furnace 10 of the steam cracking unit 2. The plastic pyrolysis effluent stream in line 11 is in upstream communication with a main feed stream for steam cracking in inlet line 13 in route to a front-end steam cracking furnace 10. The main feed stream in line 13 to be passed to the steam cracking furnace 10 may comprise a mixture of a dry gas stream, preferably comprising a stream of ethane, liquified petroleum gas, naphtha, and steam. Under this embodiment, the plastic pyrolysis effluent stream in line 11 is mixed with the main feed stream in line 13 and perhaps the recycle stream in line 202 and the mixed feed in line 12 is fed to the steam cracking furnace 10 for cracking of hydrocarbons under steam to produce a steam cracked effluent stream in line 14. The steam cracking furnace 10 may preferably, be operated at a temperature of about 750° C. (1382° F.) to about 950° C. (1742° F.).

The main feed stream in line 13 may optionally be in the gas phase. The combined feed in line 12 is fed to the steam cracking furnace 10 to heat the combined feed and pyrolyze the hydrocarbons in the plastics pyrolysis effluent stream into light olefins. Char in the plastics pyrolysis effluent stream is combusted. The steam cracking furnace 10 may be arranged in a downstream communication with the pyrolysis reactor 4 and in an upstream communication with a separation section 101. The steam cracked effluent stream in line 14 as produced from the furnace 10 is in a superheated state.

The steam cracked effluent stream in line 14 may be passed to a quench column 20, preferably an oil quench column for quenching or separating the steam cracked effluent stream 14 to produce a quenched gaseous product stream in line 22 and a quenched liquid product stream in line 24. An oil stream may be passed to the oil quench column via line 16 to contact and cool the steam cracked effluent stream by direct heat exchange. The oil stream via line 16 may be sprayed transversely into the steam cracked effluent stream in line 14. In the oil quench column 20 the quenching media rapidly extracts heat from the steam cracked effluent stream. The quenching causes a separation between lighter and heavier hydrocarbons. The oil quench column 20 separates the steam cracked effluent stream into a quenched liquid product stream recovered from a bottom of the oil quench column 20 in a bottoms line 24 and a quenched gaseous product stream flowing in line 22 taken from a top of the oil quench column 20. Some of the liquid product stream may be cooled after exiting the oil quench column 20 and recycled back to the oil quench column as the recycled oil stream in line 26. The net quenched liquid product stream in line 24 may be a fuel oil stream recovered from a bottom of the oil quench column 20. The oil quench column 20 is in a downstream communication with the steam cracking furnace 10. Under this embodiment, heating and conversion of the plastic pyrolysis effluent stream 11 in a steam cracking furnace 10 occurs prior to quenching of the plastic pyrolysis effluent stream 11 in the oil quench column 20. Optionally, quenching of the steam cracked effluent stream 14 may be performed upstream of the steam cracking unit 2.

The quenched gaseous product stream in line 22 may optionally be delivered to a water quench column 30 for quenching the quenched gaseous product stream in presence of water to produce a water quenched gaseous product stream in line 32 and a water quenched liquid product stream in line 34. Water quenching rapidly cools the quenched gaseous product stream 22 by direct contact with water. A water stream may be supplied to the water quench column 30 via a recycle line 36 to remove water from quenched gaseous product stream 22 and produce a water quenched gaseous product stream in line 32. The water stream may be sprayed transversely into the flowing quenched gaseous product stream. The water quenched gaseous product stream in line 32 is cooled so that the heavier components of the gaseous product stream condense. From a bottom of the water quench column 30 a water quenched liquid product stream is recovered in line 34 along with water stream. The water quenched liquid product stream comprises preferably heavier hydrocarbons.

The water quenched liquid product stream in line 34 may comprise a C5 hydrocarbon stream or a C5+ hydrocarbon stream or a stream heavier than the C5 hydrocarbon comprising aromatics, naphthenes, pyrolyzed gasoline (pygas), etc. The water quenched gaseous product stream in line 32 is recovered from a top of the water quench column 30. The water quenched gaseous product stream 32 may comprise lighter hydrocarbons preferably comprising C1-C4 hydrocarbons which are suitably in a gaseous phase.

The water quenched gaseous product stream in line 32 may be compressed in a compressor 40 to produce a compressed gaseous stream in line 42. Compression leads to increase in pressure of the lighter hydrocarbons contained in the water quenched gaseous product stream, to a pressure of about 1 MPag (150 psig) to about 3.8 MPag (550 psig). The compressor 40 may comprise multiple compression stages of preferably about one to about four compression stages. In this embodiment, the quenched gaseous product stream 22 may optionally be directly passed to the compressor 40, thereby bypassing the water quench column 30. The compressor 40 for compressing the water quenched gaseous product stream 32 is in upstream communication with the separation section 101 of the steam cracking unit 2. The compressor 40 is in downstream communication with the water quench column 30 and the oil quench column 20. The compressed gaseous stream in line 42 is recovered at a temperature of about 100° C. (212° F.) to about 150° C. (302° F.). The compressor 40 may comprise at least one knock-out drum 41 in downstream communication with the compressor 40 to knock-off excess liquids contained in the compressed gaseous stream in line 42. A condensed liquid stream in line 44 is separated and recovered from the bottom of the knock-out drum and the compressed gaseous stream in line 42 is recovered from the top of the knock-out drum. Under this embodiment, the compressed gaseous stream 42, may optionally be separated via fractionation into a separate C2 product stream, a C3 product stream, or a C4 product stream, by employing one or more fractionation unit(s) in the separation section 101 of the steam cracking unit 2.

In a further embodiment, the condensed liquid stream in line 44 is sent to a stabilizer column 35. The stabilizer column 35 is in downstream communication with the quench columns 20 and 30 as well as the compressor 40. The stabilizer 35 receives a combined stream in line 46 as a feed which comprises a combination of the water quenched liquid product stream in line 34 and the condensed liquid stream in line 44. The water quenched liquid product stream 34 passed to the stabilizer column 35 comprises a C5+ hydrocarbon stream. Alternatively, at least a portion or all of the water quenched liquid product stream 34 may be passed directly to a hydrotreating unit 190 to produce a hydrotreated effluent stream 194.

The stabilizer column 35 separates water from the hydrocarbons to obtain a stabilized C5+ hydrocarbon stream flowing in line 38 taken from a bottom of the stabilizer column 35. The stabilizer column 35 ejects an aqueous stream in line 36 from a top of the stabilizer column. The aqueous stream in line 36 is recycled to the water quench column 30 as a quenching media in the water quench column.

The compressed gaseous stream in line 42 may then optionally be fed to an amine scrubber 50 which is in downstream communication with the compressor 40. The compressed gaseous stream in line 42 may comprise a C5− hydrocarbon stream including light ends and C1− C4 hydrocarbons. In the amine wash column 50 the compressed gaseous stream is contacted with an amine solution which is supplied externally through line 51. The amine solution used in the amine wash column 50 may be a suitable alkanolamines selected from a monoethanolamine (MEA), or a diethanolamine (DEA), or a methyldiethanolamine (MDEA), or a diglycolamine (DGA), or a combination thereof. The amine solution is used to remove sour gases such as hydrogen sulfide and carbon dioxide from the compressed gaseous stream 42 to provide an amine washed gaseous stream in line 52 recovered from a top of the amine wash column 50. The carbon dioxide and hydrogen sulfide streams separated from the amine wash column 50 exit as an acid gas-rich stream through a bottom line 54 of the amine wash column 50 to be regenerated and recycled as an amine washed bottom stream.

The amine washed gaseous stream in line 52 recovered from the amine scrubber column 50 still comprises a trace amount of impurities such as acid gases. To achieve a high degree of acid gas removal and a better separation of impurities from the amine washed gaseous stream 52, the amine washed gaseous stream in line 52 may be passed to a caustic wash column 60. The caustic wash column 60 is in downstream communication with the amine wash column 50. In the caustic wash column 60, the amine washed gaseous stream in line 52 is contacted with an aqueous sodium hydroxide solution fed through line 61 into the caustic wash column 60 to absorb acid gases such as carbon dioxide and hydrogen sulfide into the sodium hydroxide. The carbon dioxide and sodium hydroxide produce sodium carbonate while the hydrogen sulfide and sodium hydroxide produce sodium sulfides which enter into the aqueous phase and exit from a bottom of the caustic wash column in line 64 as an acid gas rich stream to be regenerated and recycled.

The caustic washed gaseous stream in line 62 taken from a top of the caustic wash column 60 is discharged and further passed to a drier 70 to remove residual moisture. The drier is in downstream communication with the caustic wash column 60. In the drier 70, water is removed from the caustic washed gaseous stream in line 62 by contacting it with an adsorbent such as a silica gel to adsorb the water or heated to vaporize the water, removing it from the caustic washed gaseous stream. A water stream is removed in the water line 74 from the drier 70. A dried gaseous stream is recovered from the drier 70 in line 72. The dried gaseous stream in line 72 comprises C1 and C2, C3 and C4 olefins which can be recovered and used to produce plastics by polymerization.

Product recovery of at least 50 wt %, typically at least 60 wt % and suitably at least 70 wt % of valuable ethylene, propylene, and butylene products is achievable from the dried gaseous product stream. At lower, more economical carbon-to-diluent gas mole ratios, at least 40 wt % of the products recovered are valuable light olefins. Recovery of these light olefins represents a circular economy for recycling plastics. A polymerization plant may be on site, or the recovered olefins may be transported to a polymerization plant for polymer production. The recovered olefins must be separated into individual streams to be fed to a polymerization plant, The dried gaseous stream in line 72 comprising mixed light gases and C2-C4 olefins stream may be passed to a light olefin recovery section or suitably to the separation section 101 preferably comprising fractionation column(s) for recovering individual olefin streams. The separation section 101 may be in a downstream communication with the steam cracking furnace 10 of the steam cracking unit 2, the pyrolysis reactor 4, and the quench columns 20, 30, for separating effluents from each into individual olefin streams. More than one fractionation column may be used in the separation section 101 for separately recovering light gases, and individual olefin streams comprising preferably C2, C3, C4, or C4+ olefins, from the dried gaseous stream 72. The separation section 101 may be in a downstream communication with the drier 70.

The dried gaseous stream in line 72 may be fed to a first fractionation column. In the separation section 101 the arrangement of the columns may take several arrangements. In an embodiment, the first fractionation column in the separation section 101 may be a distillate stripper or a depropanizer column 80 that separates the dried gaseous mixture into a C3− hydrocarbon stream recovered from a top of the depropanizer column as an overhead stream in line 82 and a C4+ hydrocarbon stream recovered from a bottom of the depropanizer in bottoms line 84. The depropanizer column 80 may be in a downstream communication with the drier 70 and in an upstream communication with the debutanizer column 160. The depropanizer column 80 may operate at an overhead pressure of about 1000 kPag (145 psig) to about 2000 kPag (290 psig) and a bottoms temperature of about 70° C. (158° F.), preferably at least about 80° C. (176° F.), to about 150° C. The depropanized overhead stream in line 82 comprising primarily C3− hydrocarbons, may be compressed in a compressor 100, preferably a fifth stage compressor, up to a pressure of about 1500 kPag (217.56 psig) to about 3500 kPag (507.63 psig) to prepare a compressed depropanized hydrocarbon stream for acetylene recovery. The compressor 100 is in a downstream communication with the depropanizer column 80. The compressed depropanized hydrocarbon stream recovered from a bottom of the compressor 100 in line 102 is passed to an acetylene conversion zone 110.

The depropanizer overhead stream in line 82 may comprise acetylenes that require selective hydrogenation to make it a suitable ethylene feed for a polymerization plant. The compressed depropanized hydrocarbon stream in line 102 may be at an appropriate pressure for selective hydrogenation in an acetylene conversion zone 110. Hydrogen may optionally be added via line 103 to the compressed depropanized hydrocarbon stream in line 102 before it is fed to the acetylene conversion zone 110 for selective hydrogenation of acetylene from C3− hydrocarbon stream.

The acetylene conversion zone 110 is normally operated at relatively mild hydrogenation conditions in the liquid phase, so it appropriately follows the compressor 100. In the acetylene conversion zone 110, selective hydrogenation of C3− multi-olefins occurs. The acetylene conversion zone 110 is in downstream communication with the compressor 100. A broad range of suitable operating pressures in the acetylene conversion zone range from about 276 kPag (40 psig) to about 5516 kPag (800 psig), or about 345 kPag (50 psig) to about 2069 kPag (300 psig). A relatively moderate temperature between about 25° C. (77° F.) and about 350° C. (662° F.), or about 50° C. (122° F.) to about 200° C. (392° F.) is typically employed. The liquid hourly space velocity of the reactants for the selective hydrogenation catalyst may be above about 1.0 hr-1, or above about 10 hr-1, or above about 30 hr-1, to about 50 hr-1. To avoid the undesired saturation of a significant amount mono-olefinic hydrocarbons, the mole ratio of hydrogen to multi-olefinic hydrocarbons in the material entering the bed of selective hydrogenation catalyst is maintained between 0.75:1 and 1.8:1.

A selective hydrogenation catalyst is used for the acetylene conversion of C3− hydrocarbon stream. A selective hydrogenating catalyst may be any suitable catalyst which is capable of selectively hydrogenating acetylene in a C3− stream may be used in the present invention. A particularly preferred selective hydrogenation catalyst comprise copper and at least one other metal such as titanium, vanadium, chrome, manganese, cobalt, nickel, zinc, molybdenum, and cadmium or mixtures thereof. The metals are preferably supported on inorganic oxide supports such as silica and alumina. Preferably, a selective hydrogenation catalyst may comprise a copper and a nickel metal supported on alumina. The hydrogenated effluent may exit the acetylene conversion zone 110 from a bottom of the acetylene conversion zone in line 112 and enter a second drier 120. The drier 120 provides a dried gaseous stream in a bottom line 122 comprising hydrogen, hydrogenated C3−, and a mixture of methyl acetylene and propadiene (MAPD). The dried gaseous stream in line 122 may be passed to a cold box 130 located downstream of the drier 120.

The cold box 130 typically has a series of cryogenic heat exchangers that exchange heat between process and/or refrigerant streams and the hydrogenated, compressed, depropanized hydrocarbon stream in line 122. Most of the hydrogen gas is recovered from the cold box 130 as a cold box gas stream in line 133. A liquid stream recovered from the cold box in line 132 has a greater concentration of methane and C2+ hydrocarbons than in the hydrogenated, compressed, depropanized hydrocarbon stream in line 122. A lighter hydrocarbon stream is also obtained separately, as an additional product in line 131 from the cold box 130. Also, a fuel gas stream in line 134 is obtained as a second product from the cold box 130.

The cold box gas stream in line 133 may be fed to a pressure swing adsorption (PSA) zone 90 to recover purified hydrogen from the pressure swing adsorption zone 90 in line 91. The pressure swing adsorption zone 90 is in downstream communication with the cold box 130 or suitably the pressure swing adsorption zone 90 is in downstream communication with the compressor 100, the acetylene conversion zone 110 and the drier 120. The dried gaseous stream in line 122 may be separated in the cold box 130 into the hydrogen rich stream in line 133 and the lighter hydrocarbons rich stream in line 131 comprising suitably methane and C2-C3 hydrocarbons which may be used as a supplemental fuel gas stream.

The pressure swing adsorption zone 90 adsorbs hydrogen in the cold box gas stream in line 133 onto an adsorbent in a plurality of beds in series while allowing larger molecules such as methane and C2+ hydrocarbons to pass by the adsorbent in the beds. The adsorption pressure for pressure swing adsorption zone 90 may be about 1 MPa (135.30 psig) to about 1.7 MPa (235.30 psig) to adsorb hydrogen. A tail gas stream rich in methane and C2+ hydrocarbons exit the pressure swing adsorption zone 90 in a tail gas line 92. The adsorbent beds may be connected in series to cycle between pressures. Flow to each adsorbent bed is periodically terminated and the pressure in the terminated bed is decreased in stages to release void space gas and then to blow down to desorb hydrogen from the adsorbent in the terminated bed. The desorbed hydrogen passes into a hydrogen product stream in a hydrogen product line 91. A blow down pressure of 34.5 kPa (0.304 psig) to about 172 kPa (10.30 psig) may be used to desorb hydrogen from the adsorbent. A suitable adsorbent may be activated calcium zeolite A.

The tail gas stream in the tail gas line 92 may comprise about 60 to about 85 mol % hydrogen, about 15 to about 35 mol % methane, and about 1 to about 10 mol % C2+ hydrocarbons. The tail gas stream in line 92 from the pressure swing adsorption zone 90 may be added to the fuel gas stream in line 131 to form a combined fuel gas stream in line 135 to be forwarded to a fuel gas header (not shown). The fuel gas stream in line 134 may be mixed with combined fuel gas stream in line 135 to form a fuel gas mixture stream in line 136 suitably comprising methane and C2-C3 hydrocarbons. Collectively, the fuel gas mixture stream comprising methane and C2-C3 hydrocarbons in line 136 may be passed to a fuel gas header.

The cold box liquid stream rich in methane and C2+ hydrocarbons in line 132 may be fractionated in a demethanizer column 140 to provide a demethanizer overhead stream recovered from a top of a demethanizer column 140 in a demethanizer overhead line 142 comprising methane and lighter gases and a demethanizer bottoms stream recovered from a bottom of the demethanizer column in a demethanizer bottoms line comprising C2+ hydrocarbons in line 144. The demethanizer column 140 is in downstream communication with the cold box unit 130. The demethanizer overhead stream in line 142 may be recycled to the cold box 130 to further separate the demethanizer overhead stream 142 into fuel gases. The demethanizer bottoms stream in line 144 withdrawn from the demethanizer column 140 through a bottoms line is passed to the downstream deethanizer column 150. The demethanizer column 140 operates in bottoms temperature range of about −40° C. (−40° F.) to about 100° C. (212° F.), preferably about −20° C. (−4° F.) to about 0° C. (32° F.), and an overhead pressure range of about 3100 kPag (450 psig) to about 3400 (493.1 psig) kPag.

The demethanizer bottoms stream in line 144 comprising a C2+ hydrocarbon stream may be fractionated further in a deethanizer column 150 arranged in a downstream communication with the demethanizer column 140 and in downstream communication with the demethanizer column bottoms line 144. The deethanizer column separates the C2+ hydrocarbon stream into a separate C2 olefin stream suitably comprising ethylene monomers, recovered from an overhead of the deethanizer column 150 in an overhead line 152 and a separate bottom stream comprising a C3-rich hydrocarbon stream including some C4 hydrocarbons recovered from a bottom of the deethanizer column 150 through a bottom line 154. The C3 rich hydrocarbon stream recovered from the bottom of the deethanizer column 150 is concentrated in propylene monomers. The deethanizer overhead stream in line 152 may further be passed to a C2 splitter column 170, and the deethanizer bottom stream in line 154 may be passed to a C3 selective hydrogenation zone 155 for additional acetylene removal.

The C3 selective hydrogenation zone 155 is in downstream communication with the deethanizer bottom line 154 and may function like the acetylene conversion zone 110. The selective hydrogenation zone may function as a methyl acetylene and propadiene (MAPD) conversion zone. The selective hydrogenation zone 155 operates under similar reaction conditions as the acetylene conversion zone 110 and the same selective hydrogenation catalyst may be used. A selective hydrogenating catalyst may be any suitable catalyst which is capable of selectively hydrogenating acetylene in a C3 stream may be used in the present invention. A particularly preferred selective hydrogenation catalyst comprise copper and at least one other metal such as titanium, vanadium, chrome, manganese, cobalt, nickel, zinc, molybdenum, and cadmium or mixtures thereof. The metals are preferably supported on inorganic oxide supports such as silica and alumina. Preferably, a selective hydrogenation catalyst may comprise a copper and a nickel metal supported on alumina. Hydrogen may be added to the selective hydrogenation zone 155 for improved selective hydrogenation of acetylene in the C2+ olefin stream obtained in the bottom line 154. The hydrogen is supplied through a line 93 taken from the hydrogen product line 91 from the PSA unit 90. The hydrogenated effluent stream comprising C3 hydrocarbons may exit the selective hydrogenation zone 155 in line 156 and may be fed to a C3 splitter column 180 for further fractionation.

The selectively hydrogenated C3 hydrocarbon stream may optionally be passed to the C3 splitter column 180 to recover a propylene rich product stream in a C3 splitter net overhead line 182 and a propane rich stream in a C3 splitter bottoms line 184. The C3 splitter overhead stream is withdrawn from an overhead of the C3 splitter column 180 in the overhead line 182, comprising propylene monomer product, which may further be condensed and fed to a separator to recover an industrial grade plastic propylene monomer. The C3 splitter net overhead stream will be highly concentrated in propylene monomer adequate for a polymerization plant. Another stream rich in propane may be withdrawn from a bottom of the C3 splitter column 180 through a C3 splitter bottoms line 184.

A portion of the propane-rich bottoms stream in line 184 or all of the propane rich bottom stream in line 184 may be taken as a fuel gas or recycled feed to the steam cracking furnace 10. The C3 splitter column 180 may operate at an overhead pressure of about 400 kPag (58 psig) to about 2500 kPag (362.64 psig), preferably about 1600 kPag (232.00 psig) to about 1900 kPag (275.57 psig) and a bottoms temperature of about 40° C. (104° F.) to about 60° C. (140° F.). The C3 splitter column 180 may be in a downstream communication with the deethanizer column 150 and the selective hydrogenation zone 155.

In another embodiment, the deethanizer overhead stream in line 152 may be fed to a C2 splitter column 170 to recover an ethylene rich monomer product stream in an overhead line 172 from the C2 splitter column and an ethane rich stream bottom stream recovered from a bottom of the C2 splitter column in line 174. The C2 splitter overhead stream is withdrawn from an overhead of the C2 splitter column 170 in the overhead line 172, may optionally be condensed and fed to a separator for further separation into ethylene monomer product stream. The C2 splitter overhead stream 172 will be highly concentrated in ethylene, adequate for a polymerization plant. The ethane rich stream is withdrawn from the C2 splitter column 170 through a C2 splitter bottoms line 174 which may be taken as fuel gas or recycled feed to the steam cracking furnace 10. The C2 splitter column 170 may operate at an overhead pressure of about 400 kPag (58 psig) to about 2500 kPag (362.64 psig), preferably about 500 kPag (72.52 psig) to about 800 kPag (116 psig) and a bottoms temperature of about −30° C. (−22° F.) to about −10° C. (14° F.).

Turning back to the depropanizer column 80, the C4+ hydrocarbon stream obtained from the bottom of the depropanizer column 80 flowing in line 84 may be taken in whole and fed to a debutanizer column 160 to separate the depropanized bottoms stream 84 into a debutanizer overhead stream comprising a mixed C4 hydrocarbon stream and a debutanizer bottoms stream comprising a C5+ hydrocarbon stream. The debutanizer overhead stream is withdrawn from the debutanizer column 160 in a debutanizer overhead line 162. The debutanizer overhead stream in line 162 comprising mixed C4 hydrocarbons may be recovered to be further sent for butadiene extraction (not shown) in a petrochemical facility or valorized in other ways by further processing.

The debutanizer bottoms stream withdrawn in line 164 from the bottom of the debutanizer column 160 is rich in C5+ hydrocarbons which may be combined with the stabilized C5+ hydrocarbon stream in line 38. The combined C5+ hydrocarbon stream thus formed, flowing in line 192 may be collectively considered as a raw pyrolysis gasoline stream suitable for downstream processing in a hydrotreating unit 190. The debutanizer column 160 operates in a bottoms temperature range of about 140° C. (284° F.) to about 190° C. (374° F.), preferably about 140° C. (284° F.) to about 170° C. (338° F.) and an overhead pressure range of about 1500 kPag (217.6 psig) to about 1900 kPag (275.6 psig).

In the hydrotreating unit 190, the combined C5+ hydrocarbon stream in line 192 is hydrotreated to remove sulfur compounds such as hydrogen sulfide and nitrogen compounds such as ammonia thereby providing a hydrotreated effluent stream in line 194 comprising C5+ hydrocarbons and C6+ aromatics. Hydrogen is supplied to the hydrotreating unit 190 via line 193. The hydrotreating unit 190 is in downstream communication with the debutanizer column 160.

Hydrotreating is a hydroprocessing process used to remove heteroatoms such as sulfur, nitrogen, metals, etc., from hydrocarbon streams to meet fuel specifications and to saturate olefinic compounds. Hydrotreating can be performed at high or low pressures but is typically and preferably performed at a lower pressure. Typical hydrotreating conditions may comprise a reaction temperature from about 204° C. (400° F.) to about 482° C. (900° F.), preferably from about 315° C. (600° F.) to about 464° C. (850° F.); a reaction pressure from about 3.5 MPag (500 psig) to about 34.6 MPag (5000 psig), preferably from about 7 MPag (1000 psig) to about 20.8 MPag (3000 psig), a typical feed rate (LHSV) from about 0.3 hr-1 to about 20 hr-1 (v/v) preferably from about 0.5 hr-1 to about 4.0 hr-1; and an overall hydrogen consumption from about 300 $ft^3$/bbl (53.4 $m^3/m^3$) to about 2000 $ft^3$/bbl (356 $m^3/m^3$) of the liquid hydrocarbon feed. (1 $ft^3$/bbl=0.178 $m^3/m^3$)

Suitable hydrotreating catalyst may comprise any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Phosphorous may also be incorporated into the catalyst. Other suitable hydrotreating catalysts include zeolitic catalysts. More than one type of first hydrotreating catalyst may be used in the hydrotreating reactor 190. The Group VIII metal may typically be present in an amount ranging from about 2 to about 20 wt %, preferably from about 4 to about 12 wt %. The Group VI metal may typically be present in an amount ranging from about 1 to about 25 wt %, preferably from about 2 to about 25 wt %.

The hydrotreated effluent stream in line 194 may be passed to an aromatic extraction unit 200 in downstream communication with the hydrotreating unit 190. The hydrotreated effluent stream comprising C5+ hydrocarbons may be further separated in the aromatics extraction unit 200 to yield a mixed aromatic stream comprising C6+ aromatics, preferably benzene, toluene, xylene, or a combination thereof, recovered from a bottom of the aromatics extraction unit 200 in line 204 and a raffinate stream comprising non-aromatic heavy hydrocarbon stream such as a C5-C9 hydrocarbons recovered from an overhead of the aromatics extraction unit 200 in line 202. The non-aromatic heavy raffinate stream in line 202 may be used as a recycled feed stream to the steam cracking furnace 10 or may optionally be recycled for further cracking in the pyrolysis reactor. The mixed aromatics stream in line 204 can be sent for further processing to an aromatics production facility to recover valuable benzene, toluene, and xylene.

The foregoing embodiment routes the plastic pyrolysis effluent stream to the front-end furnace 10 of the steam cracking unit 2 together with the main feed in line 13 and then to quench as shown in FIG. 1.

In an alternative embodiment of FIG. 2, the plastic pyrolysis effluent stream in line 11' may be fed to the steam cracking unit 2' downstream to the steam cracking furnace 10. Many of the elements in FIG. 2 have the same configuration as in FIG. 1 and bear the same reference number. Elements in FIG. 2 that correspond to elements in FIG. 1 but have a different configuration bear the same reference numeral as in FIG. 1 but are marked with a prime symbol (').

In FIG. 2, the pyrolysis effluent stream in line 11' may optionally bypass the steam cracking furnace 10 and be passed directly for quenching and cooling in the oil quench column 20. Under this alternative, a front-end furnace 10 is employed for steam cracking of a main feed stream in line 13 which may be mixed with a recycle stream 202 to produce a mixed stream in line 12' that is fed to the steam cracking furnace 10. The steam cracking furnace 10 produces a steam cracked effluent stream in line 14'. The steam cracked effluent stream in line 14' may then be mixed with the plastic pyrolysis effluent stream in line 11' to produce a mixed pyrolysis cracked effluent stream in line 15. The line 15 transporting the mixed pyrolysis cracked effluent stream is in downstream communication with the line 11' transporting the plastic pyrolysis effluent stream and the inlet line 13 transporting the main feed stream and the steam cracking furnace 10. The mixed pyrolysis cracked effluent stream in line 15 is then quenched in the oil quench column 20 to obtain a quenched gaseous product stream comprising C4− hydrocarbons and a quenched liquid product stream comprising C5+hydrocarbons. Also, the mixed pyrolysis cracked effluent stream in line 15 may optionally be separated via fractionation in one or more fractionation unit(s) to obtain a C2 product stream, a C3 product stream, and/or a C4 product stream. The oil quench column 20 for quenching the mixed pyrolysis cracked effluent stream, may be in an upstream communication with the fractionation unit(s) of a separation section 101. The oil quench column 20 may optionally be in a downstream communication with the steam cracking furnace 10. The remainder of the embodiment of FIG. 2 operates as described for FIG. 1.

An advantageous embodiment of the disclosure is to route the plastic pyrolysis effluent stream to the quench section of the steam cracker as shown in FIG. 2. Feeding at this location is an efficient way to process the plastic pyrolysis effluent stream. This embodiment is additionally advantageous in providing a means to handle contaminants in the plastic pyrolysis effluent stream. The particulates carried over from the pyrolysis reactor may be knocked out in the oil quench, and remaining contaminants may be neutralized via the caustic scrubbing section.

In a further alternative embodiment of FIG. 3, the plastic pyrolysis effluent stream in line 11" enters the steam cracking unit 2" downstream of the quench columns 20 and 30. Many of the elements in FIG. 3 have the same configuration as in FIG. 1 and bear the same reference number. Elements in FIG. 3 that correspond to elements in FIG. 1 but have a different configuration bear the same reference numeral as in FIG. 1 but are marked with a double prime symbol (").

The main feed stream in line 13" may be mixed with the recycle stream in line 202 to provide a mixed stream in line 12" that is fed to the steam cracking furnace 10. A steam cracked effluent stream in line 14".

Under this embodiment, the plastic pyrolysis effluent stream is injected via line 11" directly into a dedicated plastics pyrolysis reactor quench column 210, preferably an oil quench column for quenching the plastic pyrolysis effluent stream to produce a quenched product stream in line 212. The quenched product stream is further separated via fractionation in a separation section 101 of the steam cracking unit 2" to produce a separate C5+ hydrocarbon stream and a C4− hydrocarbon stream.

An oil stream is passed to the quench column 210 in line 213 to contact with the plastic pyrolysis effluent stream in line 11" and to quench cool it by direct heat exchange. The oil stream in line 213 may be sprayed transversely into the ascending plastic pyrolysis effluent stream. In the oil quench column 210 the quenching media rapidly extracts heat from the plastic pyrolysis effluent stream and quenching causes a separation between lighter and heavier hydrocarbons. Thus, the oil quench column 210 produces a C5+ hydrocarbon stream taken from a bottom of the oil quench column 210 in a quench bottoms line 214 to be further processed into a fuel oil product. Alternatively, from an overhead of the oil quench column 210, a second product stream preferably comprising a C4− hydrocarbon stream in a quench overhead line 212 is passed to a compressor 220.

The compressor 220 is in direct downstream communication with the oil quench column 210. The compressor 220 compresses the C4− hydrocarbon stream in line 212 up to a pressure of about 1 MPag (145 psig) to about 2 MPag (290 psig), or suitably about 1 MPag (145 psig) to about 1.75 MPag (254 psig), preferably to about 1.72 MPag (250 psig), to produce a compressed C4− hydrocarbon stream in line 222. The compressed C4− hydrocarbon stream in line 222 is sufficiently pressured to be optionally passed to the separation section 101 for further separation of compressed C4− hydrocarbon stream into useful olefin monomers. The dried gaseous stream in line 72 comprising mixed light gases and C2-C4 olefins may optionally be combined with the compressed C4− hydrocarbon stream in line 222 to form a combined hydrocarbon stream in line 76 and be separated in the separation section 101 via fractionation in a first fractionation column, which is preferably a depropanizer column 80 as previously described for FIG. 1. The steam cracked effluent stream and the plastics pyrolysis effluent stream do not encounter each other until they both enter the separation section 101 in the combined hydrocarbon stream in line 76 in route to the first fractionation column 80.

The C5+ hydrocarbon stream in the quench bottoms line 214 from the bottom of the oil quench column 210 may be combined with the stabilized C5+ hydrocarbon stream in line 38 from the bottom of the stabilizer column 35 and combined with the debutanizer bottoms stream withdrawn in line 164 from the bottom of the debutanizer column 160 which is also rich in C5+ hydrocarbons and to provide a combined C5+ hydrocarbon stream in line 192". The combined C5+ hydrocarbon stream thus formed, flowing in line 192" may be collectively considered as a raw pyrolysis gasoline stream suitable for downstream processing in a hydrotreating unit 190. The hydrotreating unit 190 is in downstream communication with the debutanizer column 160, the stabilizer column 35 and the oil quench column 210. The combined C5+ hydrocarbon stream in line 192" is hydrotreated and further processed as described in FIG. 1.

The third embodiment of FIG. 3 cools the plastic pyrolysis effluent stream in a dedicated quench column 210 and the cooled plastic pyrolysis effluent stream is directly passed to the separation section 101 with the dried gaseous steam cracked stream 72 for separating individual olefin streams.

The disclosure thus describes various configurations for integrating recovery of plastic pyrolysis effluent stream 4 with a steam cracking unit 2, 2', or 2". Multiple configurations are shown in FIGS. 1, 2, and 3 which all may have their own individual merit.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

SPECIFIC EMBODIMENTS

While the following is described in conjunction with specific embodiments, it will be understood that this description is intended to illustrate and not limit the scope of the preceding description and the appended claims.

A first embodiment of the invention is a process for converting a pyrolysis effluent stream into hydrocarbon products comprising pyrolyzing a plastic feed stream at a temperature of at least 450° C. in a pyrolysis reactor to obtain a plastic pyrolysis effluent stream; passing the plastic pyrolysis effluent stream to a steam cracking unit to obtain a steam cracked effluent stream; and separating the steam cracked effluent stream into a C5 hydrocarbon stream and a C4 hydrocarbon stream. An embodiment of the invention is one, any or all of prior embodiments in this paragraph up through the first embodiment in this paragraph wherein separating the steam cracked effluent stream further comprises quenching the steam cracked effluent stream to obtain a quenched gaseous product stream and a quenched liquid product stream. An embodiment of the invention is one, any or all of prior embodiments in this paragraph up through the first embodiment in this paragraph further comprising converting the plastic pyrolysis effluent stream in a steam cracking furnace prior to the quenching. An embodiment of the invention is one, any or all of prior embodiments in this paragraph up through the first embodiment in this paragraph further comprising passing a main feed stream to the steam cracking furnace, the main feed stream comprises a mixture of a dry gas stream comprising ethane, liquified petroleum gas, naphtha, and steam. An embodiment of the invention is one, any or all of prior embodiments in this paragraph up through the first embodiment in this paragraph wherein the quenching of the steam cracked effluent stream is performed upstream of the steam cracking unit. An embodiment of the invention is one, any or all of prior embodiments in this paragraph up through the first embodiment in this paragraph further comprising removing water from the quenched gaseous product stream by quenching the quenched gaseous product stream with water to produce a water quenched gaseous product stream and a water quenched liquid product stream. An embodiment of the invention is one, any or all of prior embodiments in this paragraph up through the first embodiment in this paragraph further comprising compressing in a compressor the water quenched gaseous product stream to produce a compressed gaseous stream. An embodiment of the invention is one, any or all of prior embodiments in this paragraph up through the first embodiment in this paragraph wherein compressing of the water quenched gaseous product stream is performed upstream of a separation section of the steam cracking unit. An embodiment of the invention is one, any or all of prior embodiments in this paragraph up through the first embodiment in this paragraph further comprising fractionating the compressed gaseous stream in the separation section of the steam cracking unit to recover a C2 product stream, a C3 product stream, and/or a C4 product stream. An embodiment of the invention is one, any or all of prior embodiments in this paragraph up through the first embodiment in this paragraph further comprising hydrotreating at least a portion of the water quenched liquid product stream in a hydrotreating unit to produce a hydrotreated effluent stream. An embodiment of the invention is one, any or all of prior embodiments in this paragraph up through the first embodiment in this paragraph further comprising passing the hydrotreated effluent stream to an aromatic extraction unit to extract a mixed aromatic product stream and a non-aromatic raffinate stream. An embodiment of the invention is one, any or all of prior embodiments in this paragraph up through the first embodiment in this paragraph further comprising recycling the non-aromatic raffinate stream to the furnace.

A second embodiment of the invention is a process for converting a pyrolysis effluent stream into hydrocarbon products comprising heating a plastic feed stream to a temperature of more than 500° C. in a pyrolysis reactor to obtain a plastic pyrolysis effluent stream; steam cracking a main feed stream in a furnace to produce a steam cracked effluent stream; mixing the steam cracked effluent stream and the plastic pyrolysis effluent stream to produce a mixed pyrolysis cracked effluent stream; and separating the mixed pyrolysis cracked effluent stream to produce a C5 hydrocarbon stream and a C4 hydrocarbon stream. An embodiment of the invention is one, any or all of prior embodiments in this paragraph up through the second embodiment in this paragraph wherein separating the mixed pyrolysis cracked effluent stream further comprises fractionating the mixed pyrolysis cracked effluent stream in a fractionation unit to obtain a C2 product stream, a C3 product stream, and/or a C4 product stream. An embodiment of the invention is one, any or all of prior embodiments in this paragraph up through the second embodiment in this paragraph wherein separating the mixed pyrolysis cracked effluent stream further comprises quenching the mixed pyrolysis cracked effluent stream to obtain a quenched gaseous product stream comprising C4− hydrocarbons and a quenched liquid product stream comprising C5+ hydrocarbons. An embodiment of the invention is one, any or all of prior embodiments in this paragraph up through the second embodiment in this paragraph further comprising quenching the mixed pyrolysis cracked effluent stream upstream of the fractionation unit. An embodiment of the invention is one, any or all of prior embodiments in this paragraph up through the second embodiment in this paragraph further comprising quenching the mixed pyrolysis cracked effluent stream downstream of the steam cracking furnace. An embodiment of the invention is one, any or all of prior embodiments in this paragraph up through the second embodiment in this paragraph further comprising mixing the steam cracked effluent stream and the plastic pyrolysis effluent stream upstream of the quenching. An embodiment of the invention is one, any or all of prior embodiments in this paragraph up through the second embodiment in this paragraph wherein the main feed stream for steam cracking in the furnace comprises a mixture of a dry gas stream comprising ethane, liquified petroleum gas, naphtha, and steam.

A third embodiment of the invention is a process for converting a pyrolysis effluent stream into hydrocarbon products comprising heating a plastic feed stream at a temperature of about 500° C. to about 1100° C. in a pyrolysis reactor to obtain a plastic pyrolysis effluent stream; quenching the plastic pyrolysis effluent stream in a quench column to produce a quenched stream; fractionating the quenched stream in a separation section of a steam cracking unit to produce a C2 product stream, a C3 product stream, and a C4 product stream.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for converting a pyrolysis effluent stream into hydrocarbon products comprising:

pyrolyzing a plastic feed stream at a temperature of at least 450° C. in a pyrolysis reactor to obtain a plastic pyrolysis effluent stream;

passing the plastic pyrolysis effluent stream to a steam cracking unit to obtain a steam cracked effluent stream;

separating the steam cracked effluent stream into a C5 hydrocarbon stream and a C4 hydrocarbon stream;

wherein separating the steam cracked effluent stream further comprises quenching the steam cracked effluent stream to obtain a quenched gaseous product stream and a quenched liquid product stream; and removing water from the quenched gaseous product stream by quenching the quenched gaseous product stream with water to produce a water quenched gaseous product stream and a water quenched liquid product stream.

2. The process of claim 1 further comprising converting the plastic pyrolysis effluent stream in a steam cracking furnace prior to the quenching.

3. The process of claim 2 further comprising passing a main feed stream to the steam cracking furnace, the main feed stream comprises a mixture of a dry gas stream comprising ethane, liquified petroleum gas, naphtha, and steam.

4. The process of claim 1 wherein said quenching of the steam cracked effluent stream is performed upstream a separation section of the steam cracking unit.

5. The process of claim 1 further comprising compressing in a compressor the water quenched gaseous product stream to produce a compressed gaseous stream.

6. The process of claim 5 wherein compressing of the water quenched gaseous product stream is performed upstream of the separation section of the steam cracking unit.

7. The process of claim 5 further comprising fractionating the compressed gaseous stream in the separation section of the steam cracking unit to recover a C2 product stream, a C3 product stream, and/or a C4 product stream.

8. The process of claim 1 further comprising hydrotreating at least a portion of the water quenched liquid product stream in a hydrotreating unit to produce a hydrotreated effluent stream.

9. The process of claim 8 further comprising passing the hydrotreated effluent stream to an aromatic extraction unit to extract a mixed aromatic product stream and a non-aromatic raffinate stream.

10. The process of claim 9 further comprising recycling the non-aromatic raffinate stream to the furnace.

11. A process for converting a pyrolysis effluent stream into hydrocarbon products comprising:

heating a plastic feed stream to a temperature of more than 500° C. in a pyrolysis reactor to obtain a plastic pyrolysis effluent stream;

steam cracking a main feed stream in a furnace to produce a steam cracked effluent stream;

mixing the steam cracked effluent stream and the plastic pyrolysis effluent stream to produce a mixed pyrolysis cracked effluent stream;

separating the mixed pyrolysis cracked effluent stream to produce a C5 hydrocarbon stream and a C4 hydrocarbon stream;

wherein separating the mixed pyrolysis cracked effluent stream further comprises quenching the mixed pyrolysis cracked effluent stream to obtain a quenched gaseous product stream and a quenched liquid product stream; and removing water from the quenched gaseous product stream by quenching the quenched gaseous product stream with water to produce a water quenched gaseous product stream and a water quenched liquid product stream.

12. The process of claim 11 wherein separating the mixed pyrolysis cracked effluent stream further comprises fractionating the mixed pyrolysis cracked effluent stream in a fractionation unit to obtain a C2 product stream, a C3 product stream, and/or a C4 product stream.

13. The process of claim 11 wherein separating the mixed pyrolysis cracked effluent stream further comprises quenching said mixed pyrolysis cracked effluent stream to obtain a quenched gaseous product stream comprising C4− hydrocarbons and a quenched liquid product stream comprising C5+ hydrocarbons.

14. The process of claim 12 further comprising quenching the mixed pyrolysis cracked effluent stream upstream of the fractionation unit.

15. The process of claim 13 further comprising quenching the mixed pyrolysis cracked effluent stream downstream of the steam cracking furnace.

16. The process of claim 11 further comprising mixing the steam cracked effluent stream and the plastic pyrolysis effluent stream upstream of said quenching.

17. The process of claim 11 wherein the main feed stream for steam cracking in the furnace comprises a mixture of a dry gas stream comprising ethane, liquified petroleum gas, naphtha, and steam.

18. A process for converting a pyrolysis effluent stream into hydrocarbon products comprising:

heating a plastic feed stream at a temperature of about 500° C. to about 1100° C. in a pyrolysis reactor to obtain a plastic pyrolysis effluent stream;

quenching the plastic pyrolysis effluent stream in a quench column to produce a quenched stream;

fractionating the quenched stream in a separation section of a steam cracking unit to produce a C2 product stream, a C3 product stream, and a C4 product stream;

wherein separating the plastic pyrolysis cracked effluent stream further comprises quenching the plastic cracked effluent stream to obtain a quenched gaseous product stream and a quenched liquid product stream; and removing water from the quenched gaseous product stream by quenching the quenched gaseous product stream with water to produce a water quenched gaseous product stream and a water quenched liquid product stream.

* * * * *